US009661730B2

(12) United States Patent
Ueda et al.

(10) Patent No.: US 9,661,730 B2
(45) Date of Patent: May 23, 2017

(54) EXTREME ULTRAVIOLET LIGHT GENERATION APPARATUS WITH A GAS SUPPLY TOWARD A TRAJECTORY OF A TARGET

(71) Applicant: Gigaphoton Inc., Tochigi (JP)

(72) Inventors: Atsushi Ueda, Oyama (JP); Takayuki Yabu, Oyama (JP); Osamu Wakabayashi, Oyama (JP); Georg Soumagne, Oyama (JP); Takashi Saito, Oyama (JP)

(73) Assignee: Gigaphoton, Inc., Tochigi (JP)

( * ) Notice: Subject to any disclaimer, the term of this patent is extended or adjusted under 35 U.S.C. 154(b) by 0 days.

(21) Appl. No.: 15/151,025

(22) Filed: May 10, 2016

(65) Prior Publication Data

US 2016/0255707 A1 Sep. 1, 2016

Related U.S. Application Data

(63) Continuation of application No. PCT/JP2013/084744, filed on Dec. 25, 2013.

(51) Int. Cl.
*H05G 2/00* (2006.01)

(52) U.S. Cl.
CPC ..... *H05G 2/006* (2013.01); *H05G 2/008* (2013.01)

(58) Field of Classification Search
CPC ..... H05G 2/00; H05G 2/001; H05G 2/003; H05G 2/006; H05G 2/008
USPC ..... 250/504 R
See application file for complete search history.

(56) References Cited

U.S. PATENT DOCUMENTS

| | | | | |
|---|---|---|---|---|
| 8,263,953 | B2 | 9/2012 | Fomenkov et al. | |
| 8,481,983 | B2 | 7/2013 | Moriya et al. | |
| 2005/0205810 | A1* | 9/2005 | Akins | B82Y 10/00 250/504 R |
| 2008/0179548 | A1* | 7/2008 | Bykanov | B82Y 10/00 250/504 R |
| 2010/0200776 | A1* | 8/2010 | Yabu | H05G 2/003 250/504 R |
| 2012/0223257 | A1* | 9/2012 | Nagai | G03F 7/70025 250/504 R |
| 2012/0241650 | A1* | 9/2012 | Yabu | H05G 2/003 250/504 R |
| 2012/0305809 | A1* | 12/2012 | Moriya | H05G 2/008 250/504 R |

(Continued)

FOREIGN PATENT DOCUMENTS

| | | | |
|---|---|---|---|
| JP | 2007-109451 | A | 4/2007 |
| JP | 2012-182497 | A | 9/2012 |

(Continued)

OTHER PUBLICATIONS

International Search Report of PCT/P2013/084744 mailed Apr. 1, 2014.

*Primary Examiner* — Jason McCormack
(74) *Attorney, Agent, or Firm* — Studebaker & Brackett PC

(57) ABSTRACT

An extreme ultraviolet light generation apparatus may include: a chamber; a target supply unit configured to output a target toward a predetermined region inside the chamber; a first gas supply unit configured to blow out gas in a first direction toward a trajectory of the target between the target supply unit and the predetermined region; and a focusing optical system configured to concentrate a pulse laser beam to the predetermined region.

6 Claims, 11 Drawing Sheets

(56) References Cited

U.S. PATENT DOCUMENTS

| | | | |
|---|---|---|---|
| 2013/0126761 | A1 | 5/2013 | Nagai et al. |
| 2013/0161540 | A1 | 6/2013 | Nagai et al. |

FOREIGN PATENT DOCUMENTS

| | | | |
|---|---|---|---|
| JP | 2013-004369 | A | 1/2013 |
| JP | 2013-012465 | A | 1/2013 |
| JP | 2013-084993 | A | 5/2013 |
| JP | 2013-109854 | A | 6/2013 |
| JP | 2013-135033 | A | 7/2013 |

* cited by examiner

EXTREME ULTRAVIOLET LIGHT GENERATION APPARATUS WITH A GAS SUPPLY TOWARD A TRAJECTORY OF A TARGET

TECHNICAL FIELD

The present disclosure relates to an extreme ultraviolet light generation apparatus.

BACKGROUND ART

In recent years, as semiconductor processes become finer, transfer patterns for use in photolithographies of semiconductor processes have rapidly become finer. In the next generation, microfabrication at 70 nm to 45 nm, and further, microfabrication at 32 nm or less will be demanded. In order to meet the demand for microfabrication at 32 nm or less, for example, the development of an exposure apparatus in which a system for generating EUV light at a wavelength of approximately 13 nm is combined with a reduced projection reflective optical system is expected.

Three types of EUV light generation systems have been proposed, which include an LPP (laser produced plasma) type system using plasma generated by irradiating a target material with a laser beam, a DPP (discharge produced plasma) type system using plasma generated by electric discharge, and an SR (synchrotron radiation) type system using orbital radiation.

SUMMARY

An extreme ultraviolet light generation apparatus according to an aspect of the present disclosure may include: a chamber; a target supply unit configured to output a target toward a predetermined region inside the chamber; a first gas supply unit configured to blow out gas in a first direction toward a trajectory of the target between the target supply unit and the predetermined region; and a focusing optical system configured to concentrate a pulse laser beam to the predetermined region.

BRIEF DESCRIPTION OF DRAWINGS

Hereinafter, selected embodiments of the present disclosure will be described with reference to the accompanying drawings by way of example.

DESCRIPTION OF EMBODIMENTS

Contents

Figure 1:
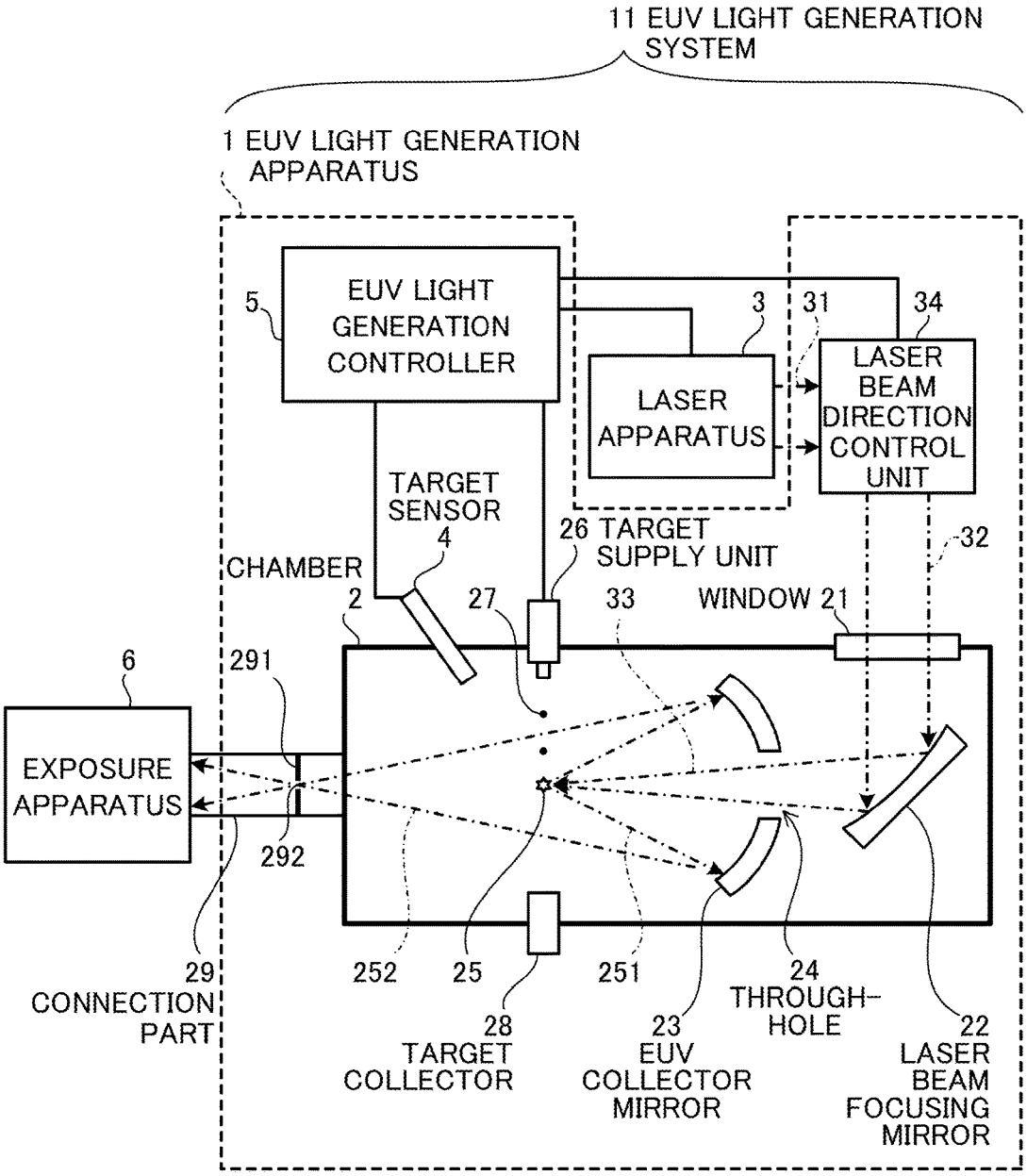
FIG. 1 schematically illustrates an exemplary configuration of an LPP type EUV light generation system.

1. Overview
2. Terms
3. Overview of Extreme Ultraviolet Light Generation System
3.1 Configuration
3.2 Operation
4. Extreme Ultraviolet Light Generation Apparatus Including Gas Supply Unit
4.1 Configuration
4.2 Operation
5. Arrangement of Exhauster
6. Control of Change in Actual Path of Target
7. Plurality of First Gas Supply Units
8. Configuration of Controller Hereinafter, selected embodiments of the present disclosure will be described in detail with reference to the accompanying drawings. The embodiments to be described below are merely illustrative in nature and do not limit the scope of the present disclosure. Further, the configuration(s) and operation(s) described in each embodiment are not all essential in implementing the present disclosure. Corresponding elements may be referenced by corresponding reference numerals and characters, and duplicate descriptions thereof will be omitted herein.

1. Overview

In an LPP-type EUV light generation apparatus, a target supply unit may output a target so that the target reaches a plasma generation region. By a laser apparatus irradiating the target with a pulse laser beam at the point in time when the target reaches the plasma generation region, the target may be turned into plasma and EUV light may be emitted from the plasma.

The EUV light thus emitted may be reflected and concentrated by an EUV collector mirror. Gas may be supplied to an area around the EUV collector mirror for the purpose of removal of debris of a target material. However, if the gas supplied to the area around the EUV collector mirror reaches a trajectory of the target between the target supply unit and the plasma generation region, the target may be swept away by the gas and deviate from the desired trajectory. This may make the target unable to reach the plasma generation region.

According to an aspect of the present disclosure, the EUV light generation apparatus may include a gas supply unit configured to blow out gas toward the trajectory of the target. This may allow the target to reach the plasma generation region.

2. Terms

Several terms used in the present application will be described below.

A "trajectory" of a target may be an ideal path of a target outputted from a target supply unit, or may be a path of a target according to the design of a target supply unit.

An "actual path" of the target may be an actual path of a target outputted from the target supply unit.

A "plasma generation region" may refer to a predetermined region where the generation of plasma for generating EUV light begins.

An "optical path axis" of a pulse laser beam may refer to a central axis of an optical path of the pulse laser beam.

3. Overview of EUV Light Generation System

3.1 Configuration

FIG. 1 schematically illustrates an exemplary configuration of an LPP type EUV light generation system. An EUV light generation apparatus 1 may be used with at least one laser apparatus 3. Hereinafter, a system that includes the EUV light generation apparatus 1 and the laser apparatus 3 may be referred to as an EUV light generation system 11. As shown in FIG. 1 and described in detail below, the EUV light generation apparatus 1 may include a chamber 2 and a target supply unit 26. The chamber 2 may be sealed airtight. The target supply unit 26 may be mounted onto the chamber 2, for example, to penetrate a wall of the chamber 2. A target material to be supplied by the target supply unit 26 may include, but is not limited to, tin, terbium, gadolinium, lithium, xenon, or a combination of any two or more of them.

The chamber 2 may have at least one through-hole formed in its wall. A window 21 may be located at the through-hole. A pulse laser beam 32 that is outputted from the laser apparatus 3 may travel through the window 21. In the chamber 2, an EUV collector mirror 23 having a spheroidal reflective surface may be provided. The EUV collector mirror 23 may have a first focusing point and a second focusing point. The reflective surface of the EUV collector mirror 23 may have a multi-layered reflective film in which molybdenum and silicon are alternately laminated, for example. The EUV collector mirror 23 may be positioned such that the first focusing point is positioned in a plasma generation region 25 and the second focusing point is positioned in an intermediate focus (IF) region 292. The EUV collector mirror 23 may have a through-hole 24, formed at the center thereof, through which a pulse laser beam 33 travels.

The EUV light generation apparatus 1 may further include an EUV light generation controller 5 and a target sensor 4. The target sensor 4 may have an imaging function and detect the presence, actual path, position, speed, and the like of a target 27.

Further, the EUV light generation apparatus 1 may include a connection part 29 for allowing the interior of the chamber 2 to be in communication with the interior of an exposure apparatus 6. A wall 291 having an aperture may be provided in the connection part 29. The wall 291 may be positioned such that the second focus position of the EUV collector mirror 23 lies in the aperture formed in the wall 291.

The EUV light generation apparatus 1 may also include a laser beam direction control unit 34, a laser beam focusing mirror 22, and a target collector 28 for collecting targets 27. The laser beam direction control unit 34 may include an optical element for defining the direction in which the laser beam travels and an actuator for adjusting the position and the orientation or posture of the optical element.

3.2 Operation

With reference to FIG. 1, a pulse laser beam 31 outputted from the laser apparatus 3 may pass through the laser beam direction control unit 34 and be outputted therefrom as the pulse laser beam 32. The pulse laser beam 32 may travel through the window 21 and enter the chamber 2. The pulse laser beam 32 may travel inside the chamber 2 along at least one laser beam path, be reflected by the laser beam focusing mirror 22, and strike at least one target 27 as a pulse laser beam 33.

The target supply unit 26 may be configured to output the target(s) 27 toward the plasma generation region 25 in the chamber 2. The target 27 may be irradiated with at least one pulse of the pulse laser beam 33. Upon being irradiated with the pulse laser beam 33, the target 27 may be turned into plasma, and emitted light 251 may be emitted from the plasma. The EUV light included in the emitted light 251 may be reflected at a higher reflectance than light at other wavelength regions by the EUV collector mirror 23. Reflected light 252, which includes the EUV light reflected by the EUV collector mirror 23, may be concentrated to the intermediate focus region 292 and be outputted to the exposure apparatus 6. Here, one target 27 may be irradiated with multiple pulses included in the pulse laser beam 33.

The EUV light generation controller 5 may be configured to integrally control the EUV light generation system 11. The EUV light generation controller 5 may be configured to process image data and the like of the target 27 captured by the target sensor 4. Further, the EUV light generation controller 5 may be configured to control at least one of the timing when the target 27 is outputted and the direction in which the target 27 is outputted. Furthermore, the EUV light generation controller 5 may be configured to control at least one of the timing when the laser apparatus 3 oscillates, the direction in which the pulse laser beam 32 travels, and the position at which the pulse laser beam 33 is focused. The various controls mentioned above are merely examples, and other controls may be added as necessary.

4. Extreme Ultraviolet Light Generation Apparatus Including Gas Supply Unit

4.1 Configuration

Figure 2:
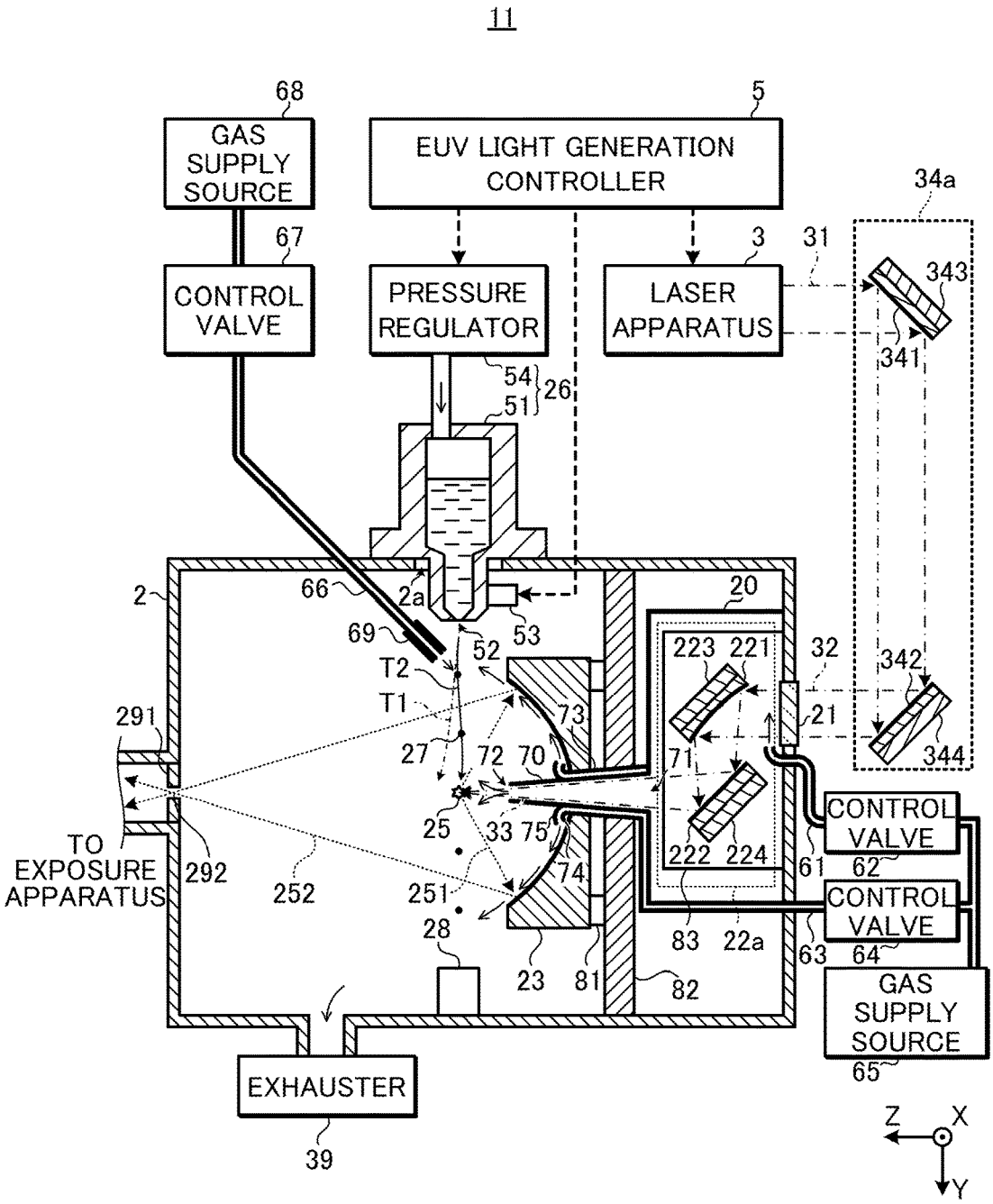
FIG. 2 is a partial cross-sectional view illustrating a configuration of an EUV light generation system according to a first embodiment.

FIG. 2 is a partial cross-sectional view illustrating a configuration of an EUV light generation system 11 according to a first embodiment. In the following description, a Y direction may substantially coincide with a direction of movement of a target 27, and may correspond to the fourth direction in the present disclosure. A Z direction may substantially coincide with a traveling direction of a pulse laser beam 33, and may correspond to the third direction in the present disclosure. Further, the Z direction may substantially coincide with a traveling direction of reflected light 252 reflected by the EUV collector mirror 23, and may correspond to the second direction in the present disclosure. An X direction may be a direction perpendicular to both the Y direction and the Z direction and perpendicular to the plane of paper in FIG. 2.

FIG. 2 shows a cross-section taken along a plane including both a trajectory of a target 27 and an optical path axis of a pulse laser beam 33. The plane including both the trajectory of the target 27 and the optical path axis of the pulse laser beam 33 may be a plane parallel to a YZ plane.

As shown in FIG. 2, a focusing optical system 22*a*, the EUV collector mirror 23, the target collector 28, an EUV collector mirror holder 81, plates 82 and 83, and a sub-chamber 20 may be provided within the chamber 2. As shown in FIG. 2, the target supply unit 26, pipes 61, 63, and 66, and an exhauster 39 may be attached to the chamber 2.

The laser apparatus 3, a laser beam direction control unit 34*a*, the EUV light generation controller 5, control valves 62, 64, and 67, and gas supply sources 65 and 68 may be provided outside the chamber 2.

The target supply unit 26 may include a reservoir 51 and a pressure regulator 54. The reservoir 51 may hold a target material in a melted state in its interior. The target material may be kept at a temperature equal to or higher than its melting point by a heater (not shown) attached to the reservoir 51. A part of the reservoir 51 may be inserted into a through-hole 2*a* formed in a wall of the chamber 2 so that an end of the reservoir 51 is positioned inside the chamber 2. The end of the reservoir 51 may be a nozzle from which a target is outputted, and an opening 52 may be formed in the nozzle.

The pressure regulator 54 may regulate, in accordance with a control signal that is outputted from the EUV light generation controller 5, the pressure of an inert gas that is supplied from an inert gas cylinder (not shown) into the reservoir 51. By the inert gas pressurizing the target material in the reservoir 51, a jet of liquid target material may be outputted from the opening 52.

A vibrating element 53 may be attached to the reservoir 51. The vibrating element 53 may impart vibration to the reservoir 51 by periodically expanding and contracting in accordance with a drive signal that is outputted from the EUV light generation controller 5. The vibration imparted to the reservoir 51 may be transmitted to the jet of target material outputted from the opening 52. This may separate the jet of target material into droplets so that the jet of target material may turn into a plurality of targets 27.

The laser apparatus 3 may include a $CO_2$ laser device. The laser apparatus 3 may output a pulse laser beam.

The laser beam direction control unit 34*a* may include high-reflecting mirrors 341 and 342. The high-reflecting mirror 341 may be supported by a holder 343. The high-reflecting mirror 342 may be supported by a holder 344.

The focusing optical system 22*a* may include an off-axis paraboloidal mirror 221 and a flat mirror 222. The off-axis paraboloidal mirror 221 may be supported by a holder 223. The flat mirror 222 may be supported by a holder 224. The holders 223 and 224 may be fixed to the plate 83. The EUV collector mirror 23 may be fixed to the plate 82 via the EUV collector mirror holder 81. The plates 82 and 83 may be fixed to the chamber 2.

The sub-chamber 20 may be located within the chamber 2. The plate 83 and the focusing optical system 22*a* may be housed within the sub-chamber 20. The sub-chamber 20 may include a hollow conical portion 70 penetrating the EUV collector mirror 23. The conical portion 70 may have respective openings at its base and at its tip. A pulse laser beam 33 may pass through the conical portion 70 from a base opening 71 to a tip opening 72 to reach the plasma generation region 25. That is, the sub-chamber 20, which includes the conical portion 70, may surround an optical path of the pulse laser beam 33 between the focusing optical system 22*a* and the plasma generation region 25.

An outer conical portion 73 may be located around the conical portion 70. There may be a space between the conical portion 70 and the outer conical portion 73. The outer conical portion 73 may penetrate the EUV collector mirror 23. The outer conical portion 73 may include a return portion 74 spreading outward at an end near the reflective surface of the EUV collector mirror 23. A return portion 75 may be fixed to an outer surface of the conical portion 70. There may be a space between the return portion 74 and the return portion 75. The space between the outer conical portion 73 and the conical portion 70 and the space between the return portions 74 and 75 may communicate with each other to form a gas passageway.

The gas supply source 65 may be connected to the interior of the sub-chamber 20 via the control valve 62 and the pipe 61. The gas supply source 65, the control valve 62, and the pipe 61 may constitute the third gas supply unit in the present disclosure.

The gas supply source 65 may also be connected to the gas passageway in the space between the conical portion 70 and the outer conical portion 73 via the control valve 64 and the pipe 63. The gas supply source 65, the control valve 64, and the pipe 63 may constitute the second gas supply unit in the present disclosure. The gas supply source 65 constituting the second gas supply unit may be the same as the gas supply source constituting the third gas supply unit.

The exhauster 39 may include a vacuum pump configured to exhaust gases from the chamber 2. By controlling an operation of the exhauster 39, the pressure inside the chamber 2 may be maintained in a predetermined range.

The gas supply source 68 may be connected to the interior of the chamber 2 via the control valve 67 and the pipe 66. A nozzle 69 may be provided at an end of the pipe 66. The gas supply source 68, the control valve 67, the pipe 66, and the nozzle 69 may constitute the first gas supply unit in the present disclosure. The control valve 67 may constitute the flow rate change mechanism in the present disclosure. In the first gas supply unit, the gas supply source 68 may be replaced by the gas supply source 65, which is the same as the gas supply source constituting the second or third gas supply unit. In the present disclosure, the gas supply source 68 is described as one configured to supply hydrogen gas. Alternatively, an inert gas may be used.

4.2 Operation

The EUV light generation controller 5 may output a control signal to the target supply unit 26 so that the target supply unit 26 outputs a target 27.

The target supply unit 26 may output multiple droplet targets 27 in sequence. The target collector 28 may be disposed upon a line extending from the trajectory of the target 27, and may collect the target 27 having passed through the plasma generation region 25.

The EUV light generation controller 5 may output a trigger signal to the laser apparatus 3. The laser apparatus 3 may output a pulse laser beam in accordance with the trigger signal.

The high-reflecting mirror 341 of the laser beam direction control unit 34*a* may be provided in an optical path of the pulse laser beam 31 outputted by the laser apparatus 3. The high-reflecting mirror 341 may reflect the pulse laser beam 31 at a high reflectance.

The high-reflecting mirror 342 may be provided in an optical path of the pulse laser beam reflected by the high-reflecting mirror 341. The high-reflecting mirror 342 may reflect the pulse laser beam at a high reflectance to introduce this beam as the pulse laser beam 32 to the focusing optical system 22*a*.

The off-axis paraboloidal mirror 221 of the focusing optical system 22*a* may be provided in an optical path of the pulse laser beam 32. The off-axis paraboloidal mirror 221 may reflect the pulse laser beam 32 toward the flat mirror 222. The flat mirror 222 may reflect the pulse laser beam, which has been reflected by the off-axis paraboloidal mirror 221, as the pulse laser beam 33 toward the plasma generation region 25 or the vicinity thereof. The pulse laser beam 33 may be concentrated to the plasma generation region 25 or the vicinity thereof according to the shape of the reflective surface of the off-axis paraboloidal mirror 221.

In the plasma generation region 25 or the vicinity thereof, a single target 27 may be irradiated with the pulse laser beam 33. Irradiation of a droplet target 27 with the pulse laser beam 33 may cause the droplet target 27 to turn into plasma to generate EUV light.

The gas supply source 65 may be connected to the control valve 62 via a pipe. The control valve 62 may be configured to be able to change the flow rate of hydrogen gas that is supplied to the pipe 61. The pipe 61 may have an opening inside the sub-chamber 20 and supply hydrogen gas to the vicinity of the window 21. The supply of hydrogen gas into the sub-chamber 20 may cause the pressure inside the sub-chamber 20 to be higher than the pressure inside the chamber 2 and outside the sub-chamber 20. The hydrogen gas supplied into the sub-chamber 20 may flow out from the tip opening 72 of the conical portion 70 toward an area around the plasma generation region 25.

Since the pressure inside the sub-chamber 20 is made higher than the pressure inside the chamber 2 by supplying the hydrogen gas into the sub-chamber 20, debris of the target material may be prevented from entering into the sub-chamber 20. Further, even if the debris of the target material adheres to the focusing optical system 22*a* and/or the window 21 inside the sub-chamber 20, the debris can be removed by etching with the hydrogen gas.

The gas supply source 65 may be connected to the control valve 64 via a pipe. The control valve 64 may be configured to be able to change the flow rate of hydrogen gas that is supplied to the pipe 63. The pipe 63 may be connected to the gas passageway formed in the space between the conical portion 70 and the outer conical portion 73 and supply hydrogen gas to the gas passageway. The hydrogen gas may flow out of the space between the return portions 74 and 75 radially from a central part of the EUV collector mirror 23 toward an outer circumferential side of the EUV collector mirror 23 along the reflective surface of the EUV collector mirror 23.

The flow of the hydrogen gas along the reflective surface of the EUV collector mirror 23 may prevent debris of the target material from reaching the reflective surface of the EUV collector mirror 23. Further, even if the debris of the target material adheres to the reflective surface of the EUV collector mirror 23, the debris can be removed by etching with the hydrogen gas.

As mentioned above, the outflow of the hydrogen gas from the tip opening 72 of the conical portion 70 toward the area around the plasma generation region 25 may cause the target 27 to be swept away by the flow of the hydrogen gas. Further, as mentioned above, the radial flow of the hydrogen gas from the central part of the EUV collector mirror 23 toward the outer circumferential side of the EUV collector mirror 23 may cause the target 27 to be swept away by the flow of the hydrogen gas. In either case, the actual path of the target 27 may be shifted in the Z direction as indicated by the actual path T1 in FIG. 2 so that the target 27 cannot reach the plasma generation region 25.

In order to solve this problem, the first gas supply unit, which includes the gas supply source 68, the control valve 67, the pipe 66, and the nozzle 69, may be provided. The gas supply source 68 may be connected to the control valve 67 via a pipe. The control valve 67 may be configured to be able to change the flow rate of hydrogen gas that is supplied to the pipe 66. The nozzle 69 may blow out hydrogen gas toward the trajectory of the target 27.

The direction in which hydrogen gas is blown out by the nozzle 69 may include a directional component of a −Z direction. Since the direction in which hydrogen gas is blown out by the nozzle 69 includes the directional component of the −Z direction, the actual path of the target 27 may be pushed back in the −Z direction as indicated by the actual path T2 in FIG. 2. The direction in which hydrogen gas is blow out by the nozzle 69 may correspond to the first direction in the present disclosure. Note here the statement that the direction in which hydrogen gas is blown out by the nozzle 69 includes the directional component of the −Z direction means that an angle formed by the direction in which hydrogen gas is blown out by the nozzle 69 and the −Z direction is less than 90 degrees.

The direction in which hydrogen gas is blown out by the nozzle 69 may further include a directional component of the Y direction. Since the direction in which hydrogen gas is blown out by the nozzle 69 includes the directional component of the Y direction, the target 27 moving toward the plasma generation region 25 may be prevented from slowing down. Note, however, that the present disclosure is not limited to the case where the direction in which hydrogen gas is blown out by the nozzle 69 includes the directional component of the Y direction. The direction in which hydrogen gas is blown out by the nozzle 69 may be perpendicular to the Y direction or may include a directional component of a −Y direction.

Figure 3:
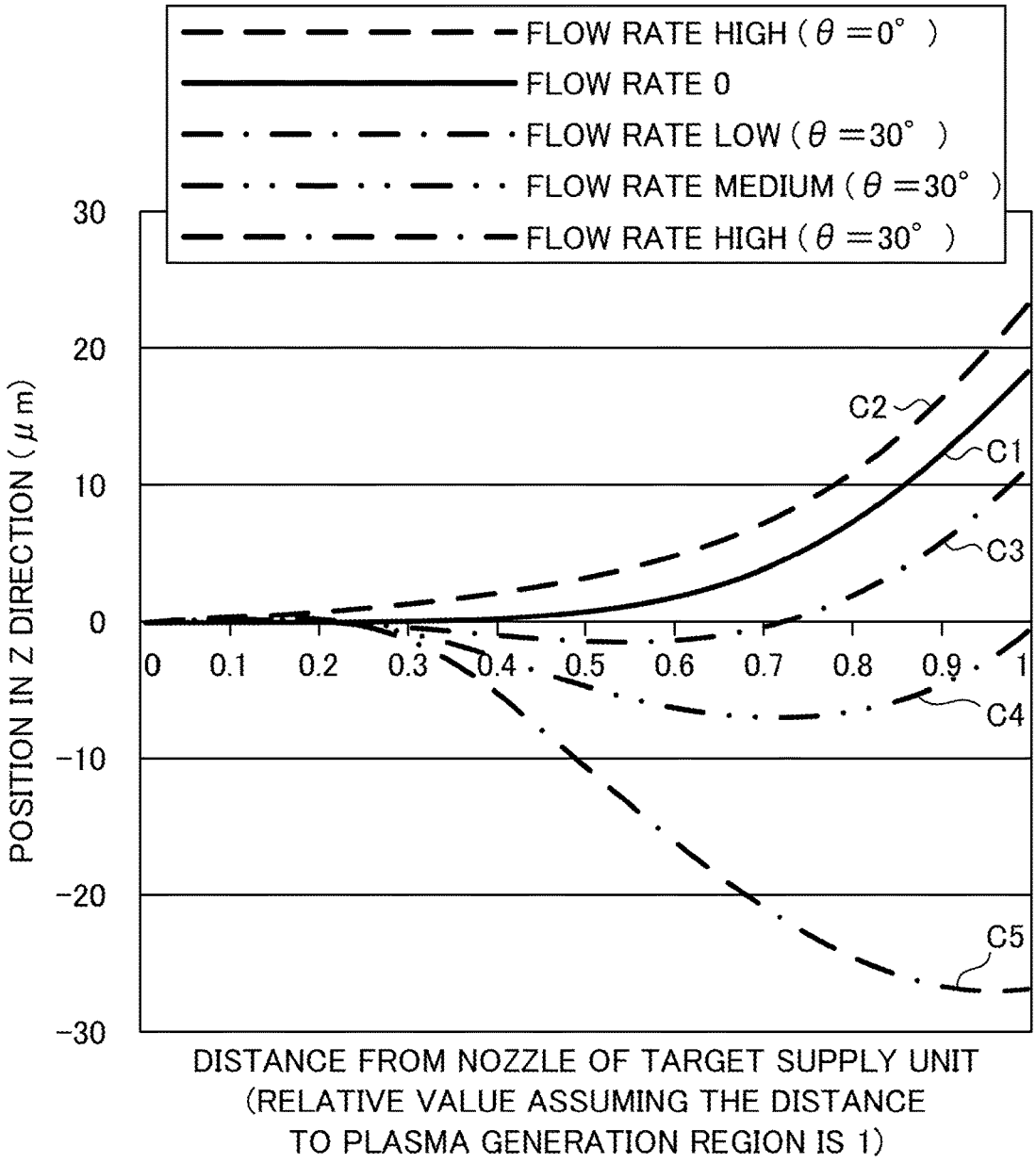
FIG. 3 is a graph showing results of simulations of an actual path of a target that is outputted from a target supply unit.

FIG. 3 is a graph showing results of simulations of an actual path of a target 27 that is outputted from the target supply unit 26. In FIG. 3, the curve C1 indicates a result of a simulation in which the supply of hydrogen gas by the nozzle 69 is not performed. The curve C2 indicates a result of a simulation in which hydrogen gas is blown out in the same direction as the direction in which the target 27 is outputted by the target supply unit 26. The curves C3 to C5 indicate results of simulations in which hydrogen gas is blown out at three different flow rates at an angle of 30 [deg] with respect to the direction in which the target 27 is outputted by the target supply unit 26. In FIG. 3, the horizontal axis represents a relative value of distance from the nozzle of the target supply unit 26 in which the opening 52 is formed, assuming that the distance from the nozzle to the center of the plasma generation region 25 is 1. In FIG. 3, the vertical axis represents the position of the target 27 in the Z direction, assuming that the center of the plasma generation region 25 is 0.

As indicated by the curve C1, in a case where the supply of hydrogen gas by the nozzle 69 is not performed, the actual path of the target 27 may be shifted in the Z direction by approximately 18 μm. The shift of the actual path of the target 27 may correspond to the order of the diameter of the target, albeit depending on the size of the target 27.

As indicated by the curve C2, in a case where hydrogen gas is blown out in the same direction as the direction in which the target 27 is outputted, the shift of the actual path of the target 27 may not be prevented.

As indicated by the curves C3 to C5, in a case where hydrogen gas is blown out at an angle of 30 [deg] with respect to the direction in which the target 27 is outputted, the actual path of the target can be returned in the −Z direction. It is desirable that the flow rate at which hydrogen gas is blown out be adjusted so that the shift of the target 27 in the vicinity of the plasma generation region 25 becomes small. Further, the direction in which hydrogen gas is blown out may be adjusted within a range of angles larger than 0 [deg] and smaller than 180 [deg] with respect to the direction in which the target 27 is outputted.

5. Arrangement of Exhauster

Figure 4:
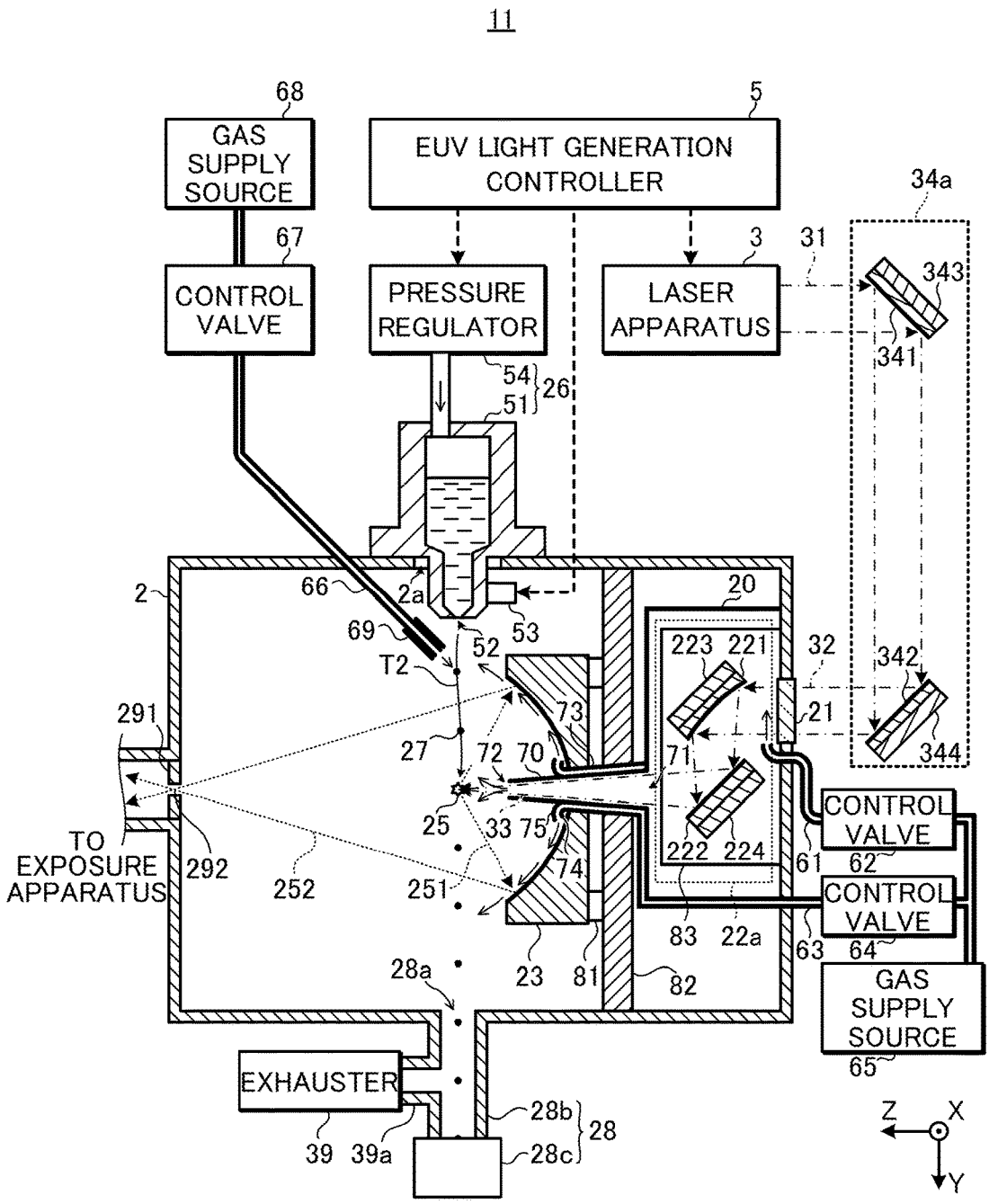
FIG. 4 is a partial cross-sectional view illustrating a configuration of an EUV light generation system according to a second embodiment.

FIG. 4 is a partial cross-sectional view illustrating a configuration of an EUV light generation system 11 according to a second embodiment. The EUV light generation system 11 according to the second embodiment may differ from the first embodiment in terms of the position at which the exhauster is connected to the chamber 2.

In the second embodiment, the target collector 28 may include a tube 28*b* and a target catcher 28*c*. The tube 28*b* may include an opening 28*a* directed to the plasma generation region 25, and the target catcher 28*c* may be connected to the tube 28*b*. The tube 28*b* and the target catcher 28*c* may be located outside the chamber 2, and the chamber 2 and the tube 28*b* may be connected to each other at the opening 28*a*. The target collector 28 may be configured to collect, at the target catcher 28*c*, a target 27 having passed through the plasma generation region 25 and the opening 28*a*. An exhaust pipe 39*a* may be connected to a side surface of the tube 28*b*. The exhauster 39 may be configured to exhaust gases from the tube 28*b* through the exhaust pipe 39*a*.

The second embodiment may be the same as the first embodiment in other respects.

Figure 5:
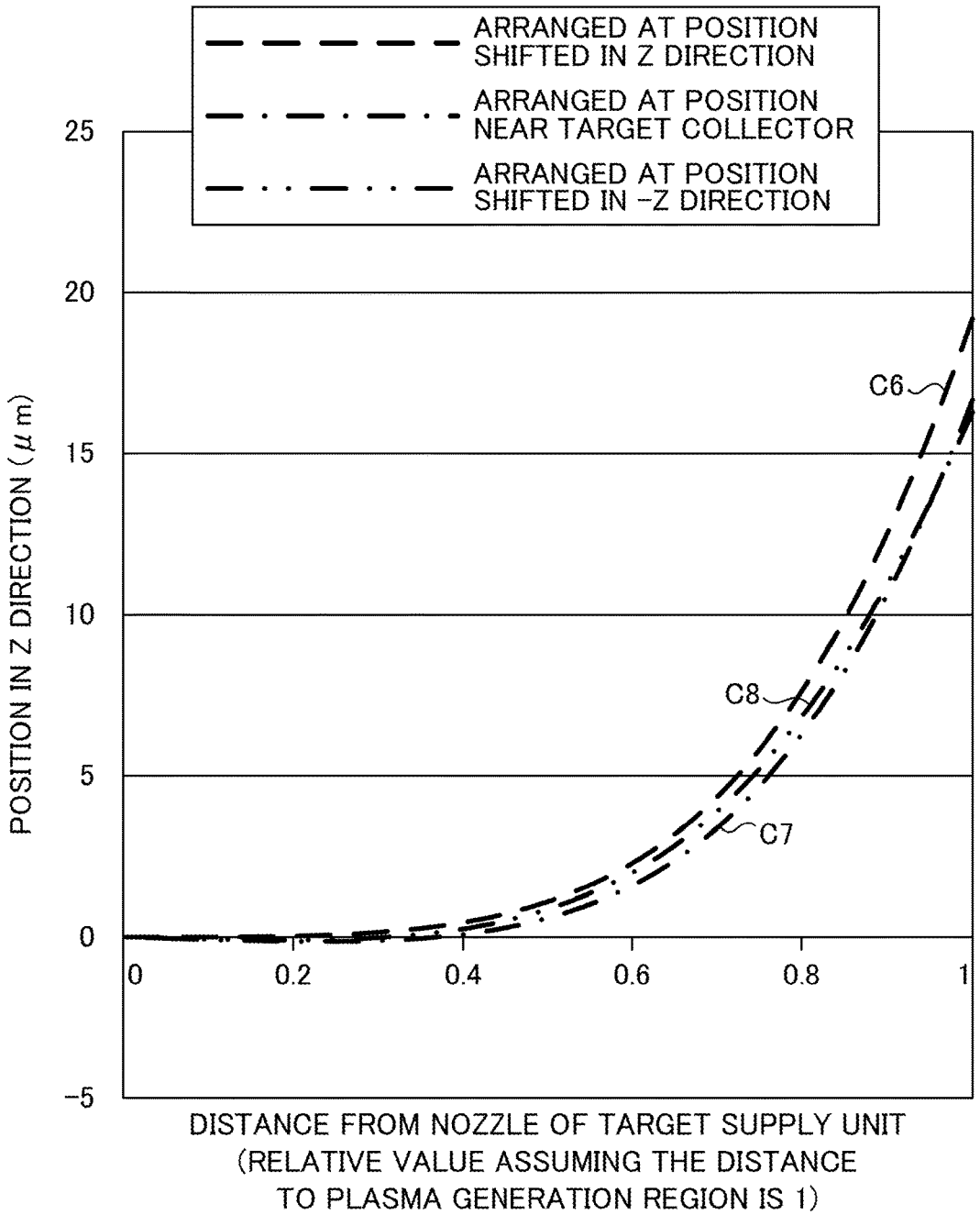
FIG. 5 is a graph showing results of simulations of an actual path of a target that is outputted from a target supply unit under other conditions.

FIG. 5 is a graph showing results of simulations of an actual path of a target 27 that is outputted from the target supply unit 26 under other conditions. In FIG. 5, the curve C6 indicates a result of a simulation in which gases are exhausted at a position shifted in the Z direction from the trajectory of the target 27. The curve C7 indicates a result of a simulation in which gases are exhausted at a position in the vicinity of the trajectory of the target 27 as shown in FIG. 4. The curve C8 indicates a result of a simulation in which gases are exhausted at a position shifted in the −Z direction from the trajectory of the target 27. In FIG. 5, the horizontal axis represents a relative value of distance from the nozzle of the target supply unit 26 in which the opening 52 is formed, assuming that the distance from the nozzle to the center of the plasma generation region 25 is 1. In FIG. 5, the vertical axis represents the position of the target 27 in the Z direction, assuming that the center of the plasma generation region 25 is 0.

As shown in FIG. 5, as compared with the case where gases are exhausted in the vicinity of the trajectory of the target 27 or at a position shifted in the −Z direction from the trajectory of the target 27, the actual path of the target 27 may be shifted in the Z direction when gases are exhausted at a position shifted in the Z direction from the trajectory of the target 27. It should be noted that there may be no great difference in terms of the actual path of the target 27 between the case where gases are exhausted in the vicinity of the trajectory of the target 27 and the case where gases are exhausted at a position shifted in the −Z direction from the trajectory of the target 27.

As compared with the first embodiment, the second embodiment makes it possible to suppress the flow of gas in the Z direction inside the chamber 2 and facilitate the flow of gas in the Y direction along the actual path of the target 27. This makes it possible to suppress the shift of the actual path of the target 27 in the Z direction and thus stabilize the actual path of the target 27. Further, as compared with the first embodiment, the second embodiment makes it possible to reduce the amount of hydrogen gas that is blown out by the nozzle 69.

6. Control of Change in Actual Path of Target

Figure 6A:
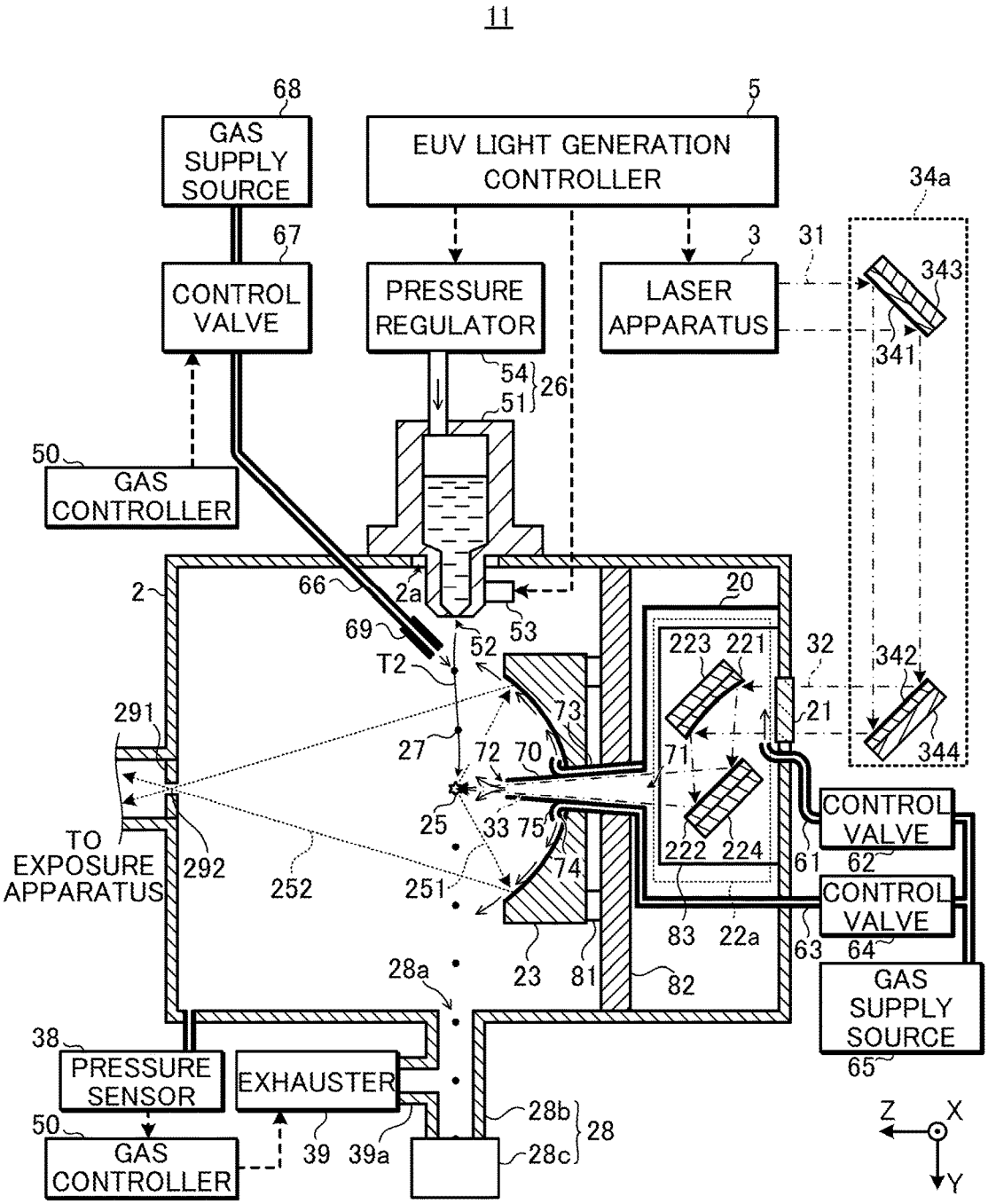
FIG. 6A is a partial cross-sectional view illustrating a configuration of an EUV light generation system according to a third embodiment.
Figure 6B:
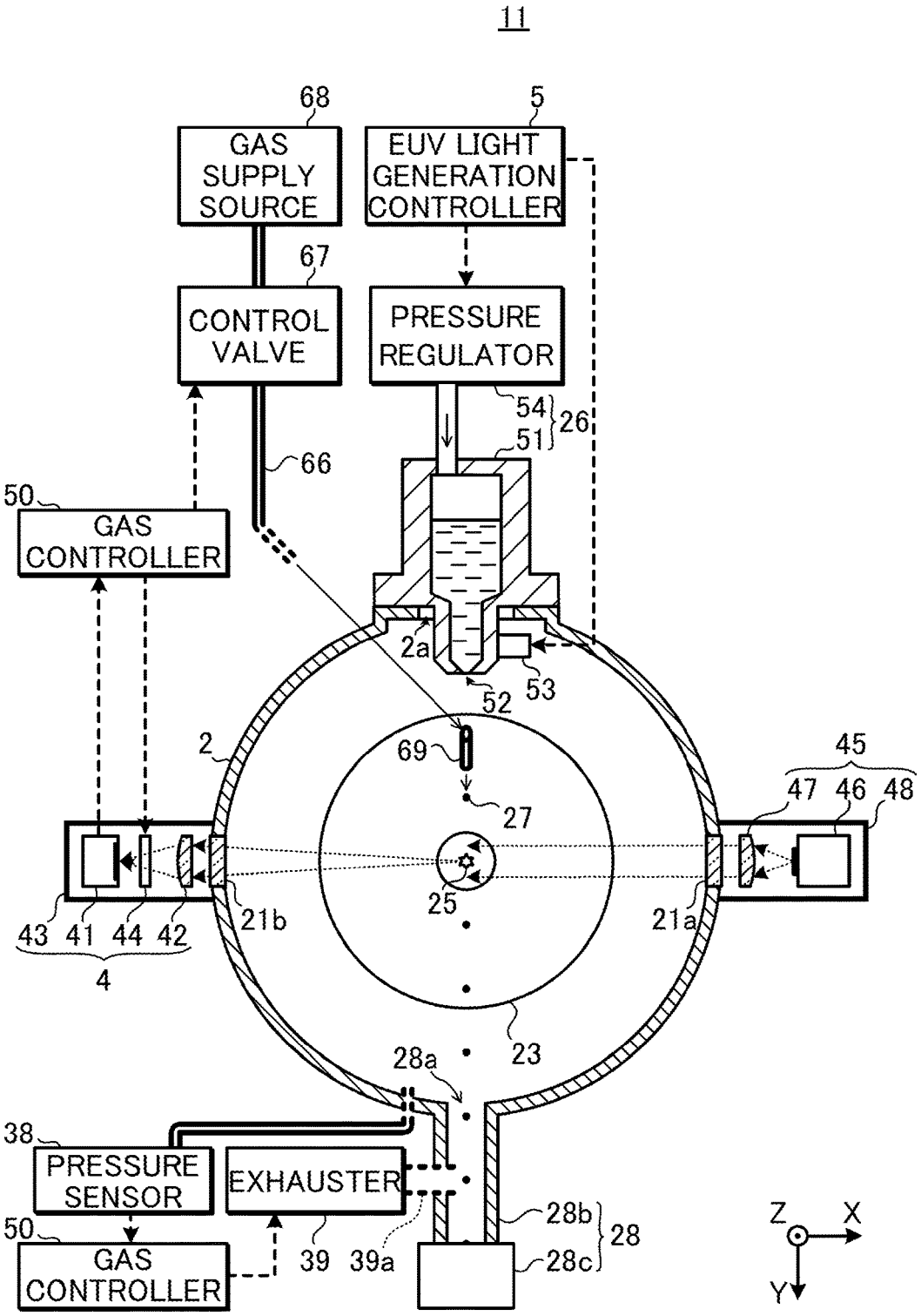
FIG. 6B is a partial cross-sectional view illustrating the configuration of the EUV light generation system according to the third embodiment.

FIGS. 6A and 6B are partial cross-sectional views illustrating a configuration of an EUV light generation system 11 according to a third embodiment. FIG. 6A shows a cross-section taken along a plane including both a trajectory of a target 27 and an optical path axis of a pulse laser beam 33. The plane including both the trajectory of the target 27 and the optical path axis of the pulse laser beam 33 may be a plane parallel to a YZ plane. FIG. 6B shows a cross-section taken along a plane including the trajectory of the target 27 and perpendicular to the optical path axis of the pulse laser beam 33. The plane including the trajectory of the target 27 and perpendicular to the optical path axis of the pulse laser beam 33 may be a plane parallel to an XY plane. FIG. 6B omits to illustrate a part of the pipe 66.

In the EUV light generation system 11 according to the third embodiment, the gas controller 50 may be configured to control, on the basis of a result of detection by the target sensor 4, the flow rate of hydrogen gas that is blown out by the nozzle 69. It should be noted that although each of FIGS. 6A and 6B illustrates two gas controllers 50, these gas controllers 50 may be integrated into one.

In the third embodiment, the target sensor 4 may be directed to the plasma generation region 25. A light-emitting unit 45 directed to the plasma generation region 25 may be attached to the chamber 2. The target sensor 4 and the light-emitting unit 45 may be disposed on opposite sides to each other with the plasma generation region 25 therebetween. One of the target sensor 4 and the light-emitting unit 45 may be disposed at a position in the X direction as seen from the plasma generation region 25, and the other of the target sensor 4 and the light-emitting unit 45 may be disposed at a position in the −X direction as seen from the plasma generation region 25.

Windows 21*a* and 21*b* may be attached to the chamber 2. The window 21*a* may be positioned between the light-emitting unit 45 and the plasma generation region 25. The window 21*b* may be positioned between the plasma generation region 25 and the target sensor 4.

The target sensor 4 may include an image sensor 41, a transfer optical system 42, a container 43, and a shutter 44. The container 43 positioned outside the chamber 2 may be fixed to the chamber 2. In the container 43, the image sensor 41, the transfer optical system 42 and the shutter 44 may be fixed. The transfer optical system 42 may transfer images of the plasma generation region 25 and an area therearound to a light-receiving unit of the image sensor 41. The shutter 44 may open for a very short time immediately preceding the arrival of the target 27 at the plasma generation region 25. Otherwise, the shutter 44 may be closed. The light-emitting unit 45 may include a light source 46, a focusing optical system 47, and a container 48. The container 48 positioned outside of the chamber 2 may be fixed to the chamber 2. In the container 48, the light source 46 and the focusing optical system 47 may be fixed.

The plasma generation region 25 and the area therearound may be irradiated with output light from the light source 46 by the focusing optical system 47. At a time following the arrival of the target 27 at an optical path of light from the light-emitting unit 45 and immediately preceding the arrival of the target 27 at the plasma generation region 25, the target sensor 4 may detect a light intensity distribution of the images of the plasma generation region 25 and the area therearound with the image sensor 41. The target sensor 4 may output this light intensity distribution to the gas controller 50. At a time when the target 27 reaches the plasma generation region 25, a pulse laser beam may reach the plasma generation region 25 so that plasma may be generated. The shutter 44 may be closed immediately before the pulse laser beam reaches the plasma generation region 25.

Furthermore, a pressure sensor 38 may be attached to the chamber 2. The pressure sensor 38 may detect the pressure inside the chamber 2 and output a detected value of the pressure to the gas controller 50. Although the gas controller 50 is described as being separate from the EUV light generation controller 5 in the present disclosure, the gas controller 50 may be included in the EUV light generation controller 5. The gas controller 50 may control the exhauster 39 on the basis of the detected value of the pressure inside the chamber 2 so that the pressure inside the chamber 2 is maintained in a predetermined range.

The third embodiment may be the same as the second embodiment in other respects.

Figure 7A:
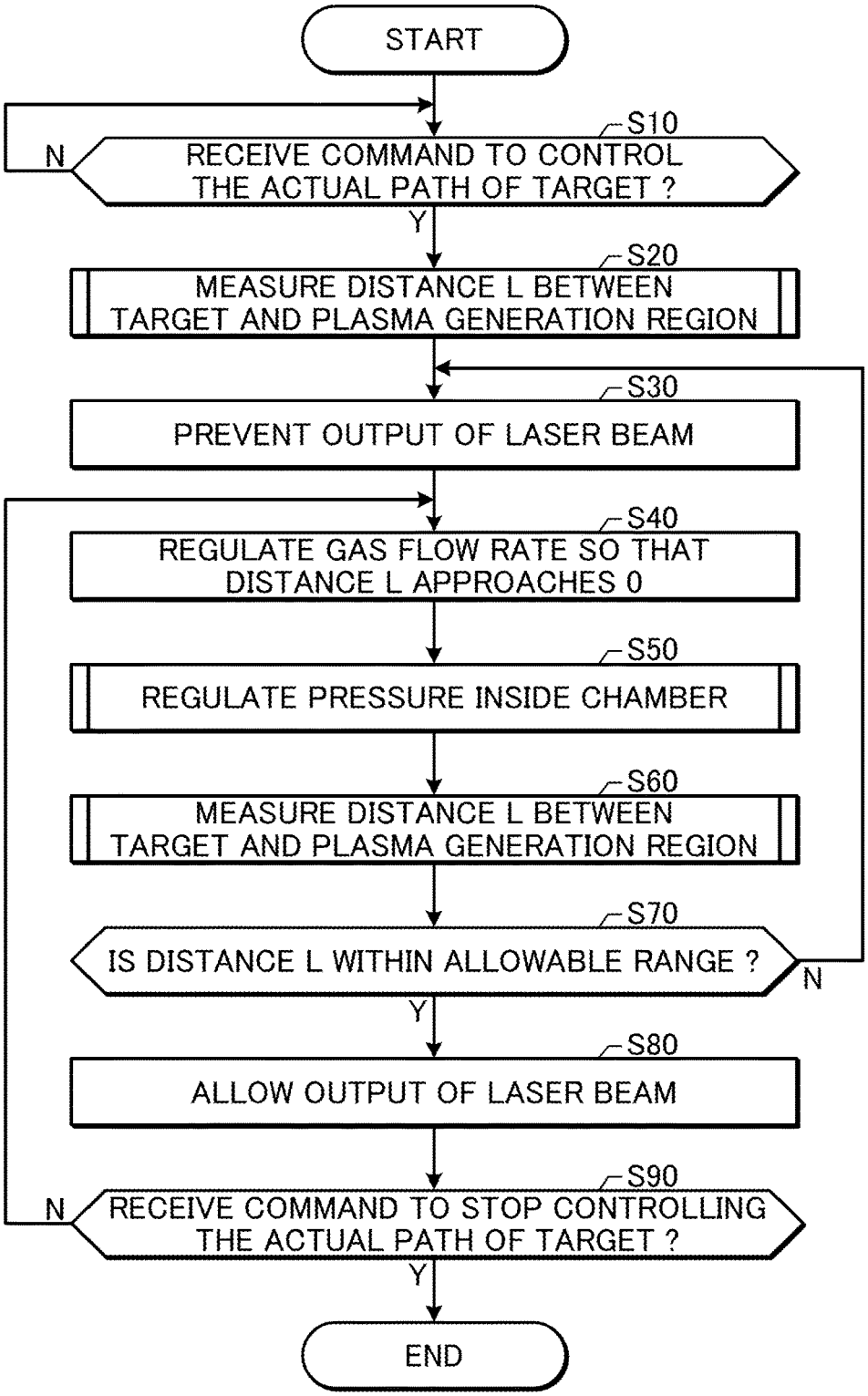
FIG. 7A is a flowchart illustrating an operation of a gas controller according to the third embodiment.

FIG. 7A is a flowchart illustrating an operation of the gas controller 50 according to the third embodiment. The gas controller 50 may perform the following process to control the flow rate of hydrogen gas that is ejected from the nozzle 69 and the pressure inside the chamber 2.

First, at S10, the gas controller 50 may determine whether it has received a command to control the actual path of a target from the EUV light generation controller 5. In a case where the gas controller 50 has not received the command to control the actual path of a target, the gas controller 50 may wait until it receives the command to control the actual path of a target. Upon receiving the command to control the actual path of a target, the gas controller 50 may proceed to S20.

At S20, the gas controller 50 may measure the distance L between a target 27 and the plasma generation region 25 using the target sensor 4. Details of this process will be described below with reference to FIG. 7B.

Next, at S30, the gas controller 50 may output a signal to prevent output of the laser beam to the EUV light generation controller 5. On the basis of this signal, the EUV light generation controller 5 may stop outputting a trigger signal to the laser apparatus 3.

Next, at S40, the gas controller 50 may control the control valve 67 to regulate the flow rate of hydrogen gas that is outputted from the nozzle 69 so that the distance L becomes closer to 0. For example, in a case where the target 27 is shifted in the Z direction from the plasma generation region 25, the gas controller 50 may increase the flow rate of hydrogen gas that is outputted from the nozzle 69. In a case where the target 27 is shifted in the −Z direction from the plasma generation region 25, the gas controller 50 may decrease the flow rate of hydrogen gas that is outputted from the nozzle 69.

Next, at S50, the gas controller 50 may control the exhauster 39 to regulate an exhaust flow rate by the exhauster 39 so that the pressure inside the chamber 2 falls within a predetermined range. Details of this process will be described below with reference to FIG. 7C.

Next, at S60, the gas controller 50 may measure the distance L between the target 27 and the plasma generation region 25 using the target sensor 4. This process may be the same as the process of S20. Details of this process will be described below with reference to FIG. 7B.

Next, at S70, the gas controller 50 may compare the distance L thus measured with a predetermined threshold value and thereby determine whether the distance L falls within an allowable range. The allowable range of the distance L may be 10% of the diameter of the target 27, for example. That is, in a case where the diameter of the target 27 is approximately 20 μm, the allowable range of the distance L may be as follows:

$$-2\ \mu m \leq L \leq 2\ \mu m$$

In a case where the distance L does not fall within the allowable range, the gas controller 50 may return to S30 and repeat S30 and the subsequent steps to further regulate the flow rate of hydrogen gas that is outputted from the nozzle 69. In a case where the distance L falls within the allowable range, the gas controller 50 may proceed to S80.

At S80, the gas controller 50 may output a signal to allow output of the laser beam to the EUV light generation controller 5. On the basis of this signal, the EUV light generation controller 5 may start outputting a trigger signal to the laser apparatus 3.

Next, at S90, the gas controller 50 may determine whether it has received a command to stop controlling the actual path of a target from the EUV light generation controller 5. In a case where the gas controller 50 has not received the command to stop controlling the actual path of a target, the gas controller 50 may return to S40 and repeat S40 and the subsequent steps. Upon receiving the command to stop controlling the actual path of a target, the gas controller 50 may end the process illustrated in this flowchart.

Figure 7B:
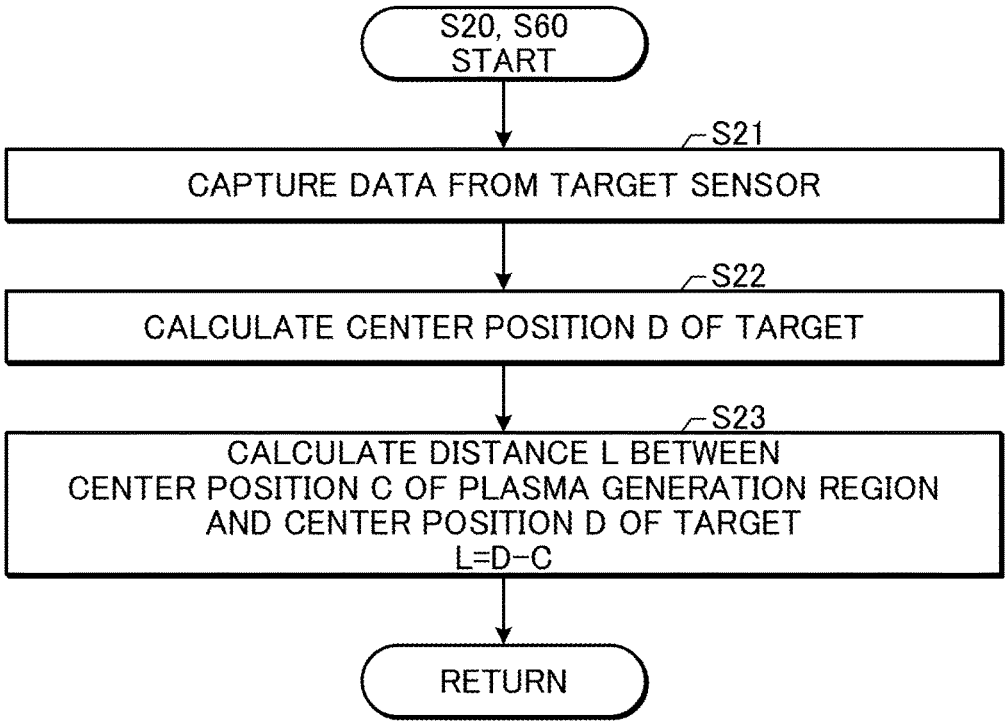
FIG. 7B is a flowchart illustrating details of a process for measuring a distance L illustrated in FIG. 7A.

FIG. 7B is a flowchart illustrating details of the process for measuring the distance L illustrated in FIG. 7A. The process illustrated in FIG. 7B may be performed by the gas controller 50 as a subroutine of S20 or S60 illustrated in FIG. 7A.

First, at S21, the gas controller 50 may capture the light intensity distribution outputted from the target sensor 4.

Next, at S22, the gas controller 50 may calculate a center position D of the target 27 on the basis of the light intensity distribution. For example, in a case where the light intensity distribution includes a circle indicating the shape of the target 27, the gas controller 50 may calculate the center position of the circle. Further, in a case where the light intensity distribution includes the shape of a band indicating an actual path along which the target 27 moves over a predetermined period of time, the gas controller 50 may calculate the position of the center line of the band. The center position D of the target 27 may be a center position in the Z direction.

Next, at S23, the gas controller 50 may calculate the distance L between a center position C of the plasma generation region 25 and the center position D of the target 27 according to the following formula:

$$L = D - C$$

The center position C of the plasma generation region 25 may be a center position in the Z direction.

After that, the gas controller 50 may end the process illustrated in this flowchart.

Figure 7C:
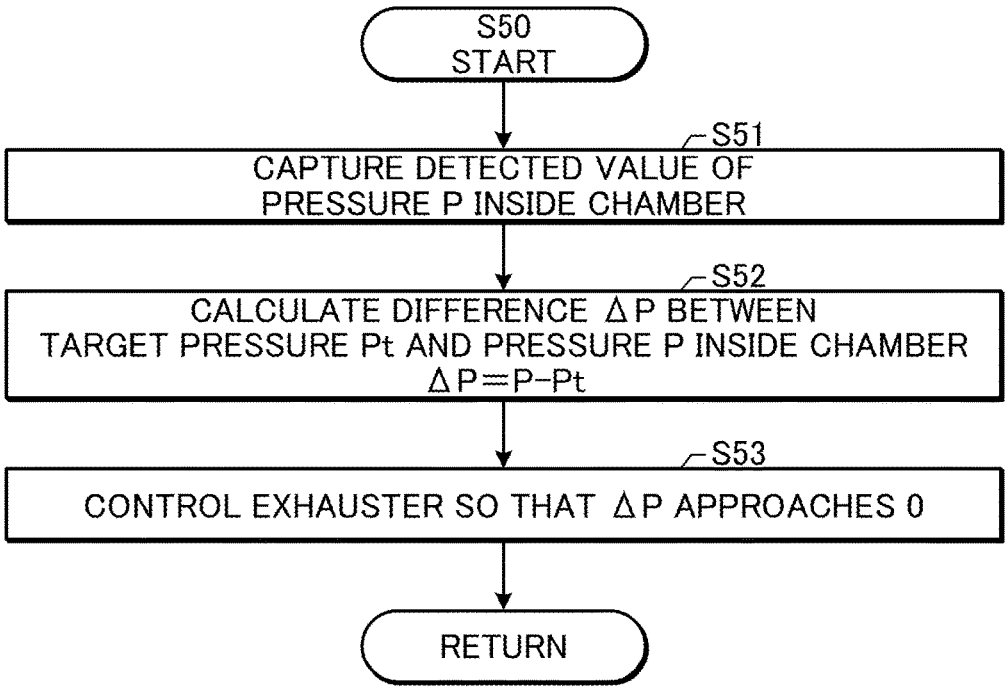
FIG. 7C is a flowchart illustrating details of a process for controlling pressure inside a chamber illustrated in FIG. 7A.

FIG. 7C is a flowchart illustrating details of the process for controlling the pressure inside the chamber illustrated in FIG. 7A. The process illustrated in FIG. 7C may be performed by the gas controller 50 as a subroutine of S50 illustrated in FIG. 7A.

First, at S51, the gas controller 50 may capture a detected value of a pressure P inside the chamber 2 outputted from the pressure sensor 38.

Next, at S52, the gas controller 50 may calculate a difference ΔP between a target pressure Pt and the pressure P inside the chamber 2 according to the following formula:

$$\Delta P = P - Pt$$

The target pressure Pt may be a value defined within a range of not lower than 5 Pa and not higher than 20 Pa.

Next, at S53, the gas controller 50 may control the exhauster 39 so that the difference ΔP becomes closer to 0. For example, in a case where the pressure P inside the chamber 2 is higher than the target pressure Pt, the gas controller 50 may increase the exhaust flow rate by the exhauster 39. In a case where the pressure P inside the chamber 2 is lower than the target pressure Pt, the gas controller 50 may decrease the exhaust flow rate by the exhauster 39.

After that, the gas controller 50 may end the process illustrated in this flowchart.

This process makes it possible to adjust the flow rate of hydrogen gas by the nozzle 69 so that the target 27 passes through the plasma generation region 25.

Although the third embodiment has described a case where the target sensor 4 is disposed at a position in the X or −X direction as seen from the plasma generation region 25, the present disclosure is not limited to this. The target sensor 4 may be disposed at another position, provided that such a position allows measurement of a shift of the position of the target 27 from the plasma generation region 25 in the Z direction.

Although the third embodiment has described a case where the target sensor 4 and the light-emitting unit 45 are disposed on opposite sides to each other with the plasma generation region 25 therebetween, the present disclosure is not limited to this. The target sensor 4 and the light-emitting unit 45 may be disposed on substantially the same side as seen from the plasma generation region 25, and the target sensor 4 may detect light reflected by a target irradiated with light from the light-emitting unit 45.

Although the third embodiment has described a case where the control valve 67 is controlled, the present disclosure is not limited to this. By the gas controller 50 controlling the control valves 62 and 64 or either of them, the flow rate of hydrogen gas that flows to the trajectory of the target 27 may be regulated. In this case, the control valve 67 does not need to be controlled.

7. Plurality of First Gas Supply Units

Figure 8:
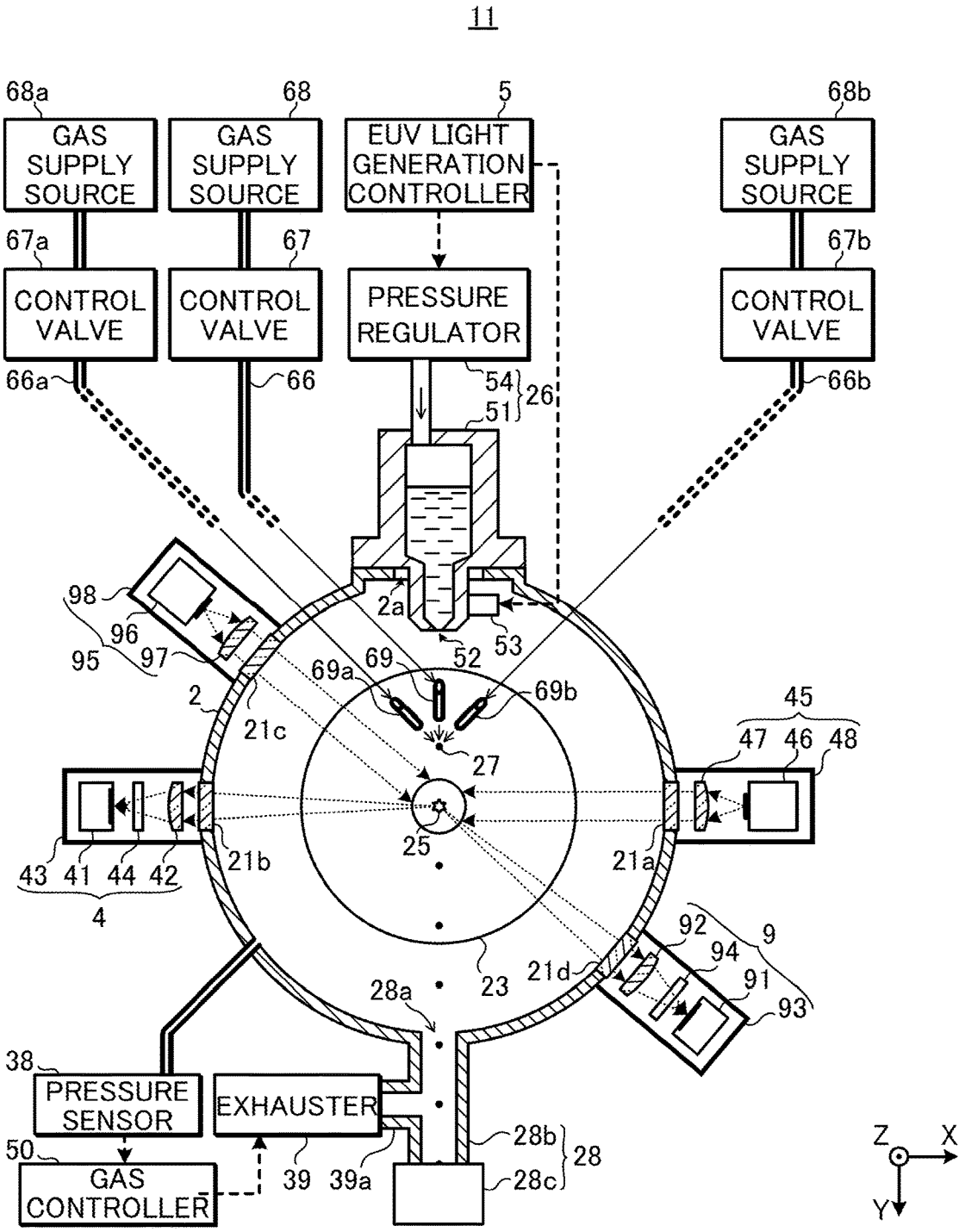
FIG. 8 is a partial cross-sectional view illustrating a configuration of an EUV light generation system according to a fourth embodiment.

FIG. 8 is a partial cross-sectional view illustrating a configuration of an EUV light generation system 11 according to a fourth embodiment. FIG. 8 shows a cross-section taken along a plane including the trajectory of the target 27 and perpendicular to the optical path axis of the pulse laser beam 33. The plane including the trajectory of the target 27 and perpendicular to the optical path axis of the pulse laser beam 33 may be a plane parallel to an XY plane. In the fourth embodiment, as shown in FIG. 8, a plurality of first gas supply units may be provided. The plurality of first gas supply units may blow out hydrogen gas toward the trajectory of the target 27.

The first gas supply unit including the gas supply source 68, the control valve 67, the pipe 66, and the nozzle 69 may blow out hydrogen gas in a direction including a directional component of the −Z direction and a directional component of the Y direction.

Another first gas supply unit including a gas supply source 68*a*, a control valve 67*a*, a pipe 66*a*, and a nozzle 69*a* may blow out hydrogen gas in a direction including a directional component of the −Z direction, a directional component of the Y direction, and a directional component of the X direction.

Still another first gas supply unit including a gas supply source 68*b*, a control valve 67*b*, a pipe 66*b*, and a nozzle 69*b* may blow out hydrogen gas in a direction including a directional component of the −Z direction, a directional component of the Y direction, and a directional component of the −X direction.

By controlling the flow rate of hydrogen gas that is supplied by each of the plurality of first gas supply units, the position of a target in the X direction, as well as the Z direction, may be adjusted. It should be noted that FIG. 8 omits to illustrate a part of each of the pipes 66, 66*a*, and 66*b*. Further, FIG. 8 omits to illustrate signal lines connecting the control valves 67, 67*a*, 67*b*, the target sensor 4 and a target sensor 9 to the gas controller 50.

In the fourth embodiment, as shown in FIG. 8, the target sensor 4 and the target sensor 9 may be provided. The target sensor 9 may be disposed at a position shifted in the Y direction from the plasma generation region 25. Furthermore, a light-emitting unit 95 may be attached to the chamber 2. The target sensor 9 and the light-emitting unit 95 may be disposed on opposite sides to each other with the plasma generation region 25 therebetween.

Windows 21*c* and 21*d* may be attached to the chamber 2. The window 21*c* may be positioned between the light-emitting unit 95 and the plasma generation region 25. The window 21*d* may be positioned between the plasma generation region 25 and the target sensor 9.

The target sensor 9 may include an image sensor 91, a transfer optical system 92, a container 93, and a shutter 94. The light-emitting unit 95 may include a light source 96, a focusing optical system 97, and a container 98. The target sensor 9 may have the same configuration and function as the target sensor 4, except that the target sensor 9 is disposed at a position shifted in the Y direction from the plasma generation region 25. The light-emitting unit 95 may have the same configuration and function as the light-emitting unit 45.

This allows the gas controller 50 to not only calculate the position of the target 27 in the Z direction on the basis of the data from the target sensor 4, but also to calculate the position of the target 27 in the X direction on the basis of data from the target sensor 9. The gas controller 50 may adjust the position of the target 27 in the X direction within a desired range by controlling the plurality of first gas supply units on the basis of the position of the target 27 in the X direction.

The fourth embodiment may be the same as the third embodiment in other respects.

Although the fourth embodiment has described a case where the plurality of first gas supply units are controlled, the present disclosure is not limited to this. In a case where the target sensor 9 has detected a shift of the target 27 in the X direction, an alternative configuration for correcting the shift of the target 27 in the X direction may be adopted. An example of this alternative configuration is the use of an X-axis stage configured to adjust the position of the target supply unit 26 in the X direction.

8. Configuration of Controller

Figure 9:
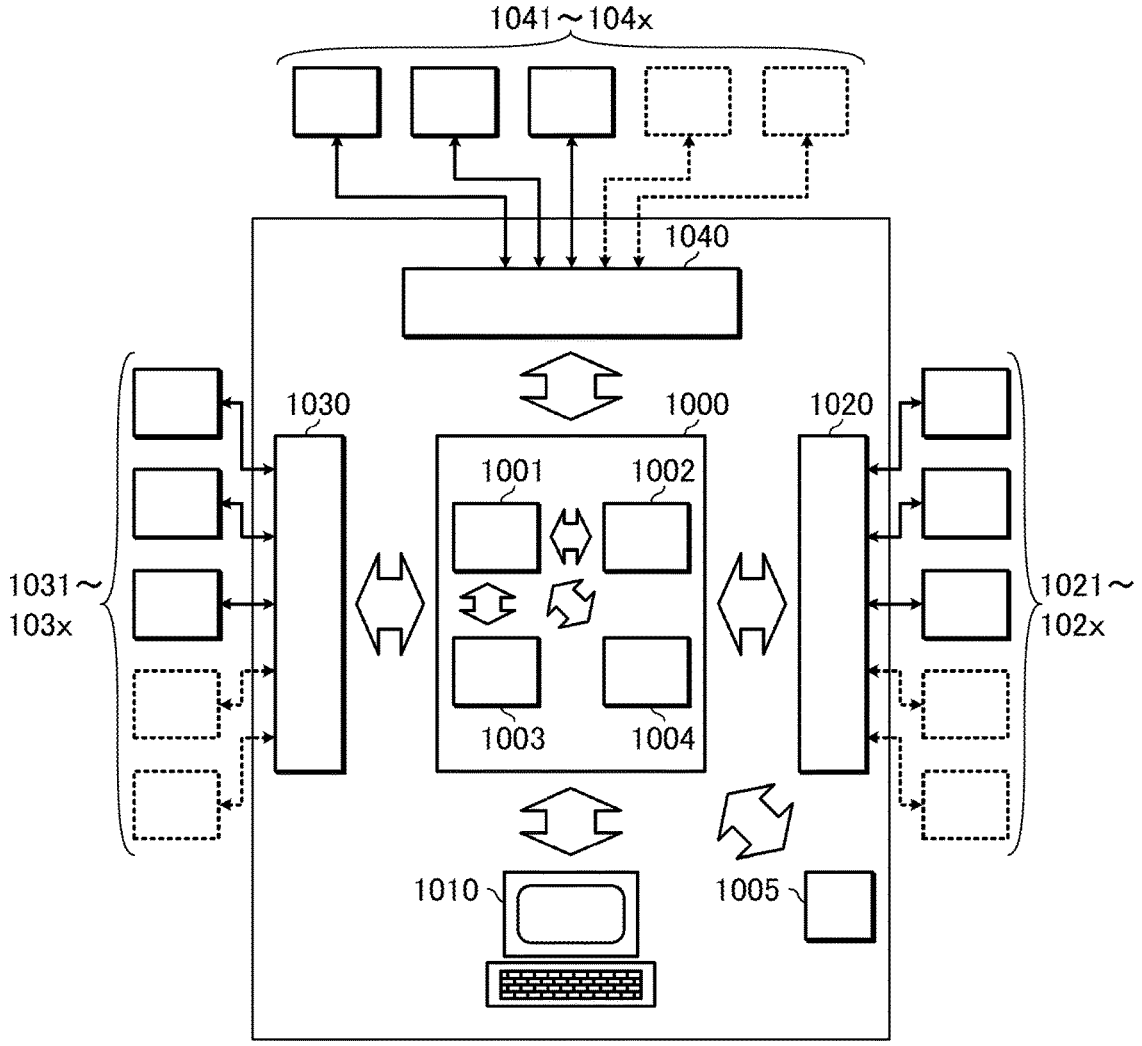
FIG. 9 is a block diagram schematically illustrating a configuration of a controller.

FIG. 9 is a block diagram schematically illustrating a configuration of a controller.

Each of the controllers such as the EUV light generation controller 5 and the gas controller 50 in the above-described embodiments may be constituted by a general-purpose control device such as a computer or a programmable controller. For example, the controller may be constituted as described below.

(Configuration)

The controller may include a processing unit 1000, and a storage memory 1005, a user interface 1010, a parallel input/output (I/O) controller 1020, a serial I/O controller 1030, and an analog-to-digital (A/D) and digital-to-analog (D/A) converter 1040 that are connected to the processing unit 1000. The processing unit 1000 may include a central processing unit (CPU) 1001, and a memory 1002, a timer 1003, and a graphics processing unit (GPU) 1004 that are connected to the CPU 1001.

(Operation)

The processing unit 1000 may read out programs stored in the storage memory 1005. The processing unit 1000 may execute read-out programs, read out data from the storage memory 1005 in accordance with the execution of the programs, or store data in the storage memory 1005.

The parallel I/O controller 1020 may be connected to devices 1021 to 102*x* communicable through parallel I/O ports. The parallel I/O controller 1020 may control communication using digital signals through parallel I/O ports that is performed in the process where the processing unit 1000 executes programs.

The serial I/O controller 1030 may be connected to devices 1031 to 103*x* communicable through serial I/O ports. The serial I/O controller 1030 may control communication using digital signals through serial I/O ports that is performed in the process where the processing unit 1000 executes programs.

The A/D and D/A converter 1040 may be connected to devices 1041 to 104*x* communicable through analog ports. The A/D and D/A converter 1040 may control communication using analog signals through analog ports that is performed in the process where the processing unit 1000 executes programs.

The user interface 1010 may be configured to display progress of executing programs by the processing unit 1000 to an operator or to receive instructions by the operator to the processing unit 1000 to stop execution of the programs or to execute interruption processing.

The CPU 1001 of the processing unit 1000 may perform arithmetic processing of programs. In the process where the CPU 1001 executes programs, the memory 1002 may temporally store programs or temporally store data in the arithmetic process. The timer 1003 may measure time or elapsed time to output the time or the elapsed time to the CPU 1001 in accordance with the execution of the programs. When image data is input to the processing unit 1000, the GPU 1004 may process the image data in accordance with the execution of the programs and output the results to the CPU 1001.

The devices 1021 to 102*x* communicable through parallel I/O ports, which are connected to the parallel I/O controller 1020, may be the laser apparatus 3, the exposure apparatus 6, another controller, or the like.

The devices 1031 to 103*x* communicable through serial I/O ports, which are connected to the serial I/O controller 1030, may be the target sensor 4, the target supply unit 26, or the like.

The devices 1041 to 104*x* communicable through analog ports, which are connected to the A/D and D/A converter 1040, may be various sensors such as the pressure sensor 38.

With the above-described configuration, the controller may be capable of achieving the operation illustrated in each of the embodiments.

The above-described embodiments and the modifications thereof are merely examples for implementing the present disclosure, and the present disclosure is not limited thereto. It will be clear to those skilled in the art that making various modifications according to the specifications or the like is within the scope of the present disclosure, and other various embodiments are possible within the scope of the present disclosure.

The terms used in this specification and the appended claims should be interpreted as "non-limiting." For example, the terms "include" and "be included" should be interpreted as "including the stated elements but not limited to the stated elements." The term "have" should be interpreted as "having the stated elements but not limited to the stated elements." Further, the modifier "one (a/an)" should be interpreted as "at least one" or "one or more."

The invention claimed is:

1. An extreme ultraviolet light generation apparatus comprising:

a chamber;

a target supply unit configured to output a target toward a predetermined region inside the chamber;

a first gas supply unit configured to blow out gas in a first direction toward a trajectory of the target between the target supply unit and the predetermined region;

a focusing optical system configured to concentrate a pulse laser beam to the predetermined region;

a flow rate change mechanism configured to change a flow rate of gas that is blown out by the first gas supply unit;

a target sensor configured to detect a position through which the target passes; and a controller configured to control the flow rate change mechanism on a basis of a result of detection by the target sensor.

2. The extreme ultraviolet light generation apparatus according to claim 1, further comprising:

an EUV collector mirror having a reflective surface configured to reflect, in a second direction, extreme ultraviolet light generated in the predetermined region and concentrate the extreme ultraviolet light; and a second gas supply unit configured to cause gas to flow along the reflective surface of the EUV collector mirror, wherein the first direction has a directional component of a direction opposite to the second direction.

3. The extreme ultraviolet light generation apparatus according to claim 1, further comprising:

a sub-chamber surrounding an optical path of a pulse laser beam between the focusing optical system and the predetermined region and having an opening directed to the predetermined region so that the pulse laser beam passes through the opening in a third direction toward the predetermined region; and a third gas supply unit configured to supply gas to the sub-chamber, wherein the first direction has a directional component of a direction opposite to the third direction.

4. The extreme ultraviolet light generation apparatus according to claim 1, wherein the target supply unit is configured to output a target in a fourth direction toward the predetermined region, and the first direction has a directional component of a direction identical to the fourth direction.

5. The extreme ultraviolet light generation apparatus according to claim 1, further comprising:

a target collector including a tube having an opening directed to the predetermined region, the target collector being configured to collect a target having passed through the predetermined region and the opening; and an exhauster including an exhaust pipe connected to a side surface of the tube, the exhauster being configured to exhaust gas from the tube through the exhaust pipe.

6. The extreme ultraviolet light generation apparatus according to claim 1, wherein the target sensor includes:

an image sensor;

a transfer optical system configured to transfer images of the predetermined region and an area therearound to the image sensor; and a shutter located between the image sensor and the predetermined region.

* * * * *